US007396288B2

(12) United States Patent
McLauhglin

(10) Patent No.: US 7,396,288 B2
(45) **Date of Patent: *Jul. 8, 2008**

(54) PUTTING TRAINING DEVICE

(76) Inventor: Terence Kevin Patrick McLauhglin, 3256 Karley Cres., Coquitlam, British Columbia (CA) V3E 3E9

( * ) Notice: Subject to any disclaimer, the term of this patent is extended or adjusted under 35 U.S.C. 154(b) by 146 days.

This patent is subject to a terminal disclaimer.

(21) Appl. No.: 11/144,190

(22) Filed: Jun. 4, 2005

(65) Prior Publication Data

US 2006/0276257 A1 Dec. 7, 2006

(51) Int. Cl.
*A63B 69/36* (2006.01)

(52) U.S. Cl. ..... 473/236; 473/238; 473/251

(58) Field of Classification Search ..... 473/236, 473/265

See application file for complete search history.

(56) References Cited

U.S. PATENT DOCUMENTS

| | | | | | |
|---|---|---|---|---|---|
| 3,021,141 | A * | 2/1962 | Polsky et al. | ..... | 473/236 |
| 3,039,776 | A * | 6/1962 | Faini | ..... | 473/236 |
| 3,298,693 | A * | 1/1967 | Eisenberg | ..... | 473/238 |
| 3,870,315 | A * | 3/1975 | Lawlor et al. | ..... | 473/264 |
| 4,789,158 | A * | 12/1988 | Chiesa | ..... | 473/238 |
| 4,953,867 | A * | 9/1990 | Rigsby | ..... | 473/238 |
| 5,011,153 | A * | 4/1991 | Watkins | ..... | 473/236 |
| 5,441,268 | A * | 8/1995 | Shier | ..... | 473/236 |
| 5,551,695 | A * | 9/1996 | Wolk | ..... | 473/236 |
| 5,595,543 | A * | 1/1997 | Wolk | ..... | 473/162 |
| 5,716,286 | A * | 2/1998 | Swan | ..... | 473/175 |
| 5,810,675 | A * | 9/1998 | Weathers | ..... | 473/236 |
| 5,924,935 | A * | 7/1999 | Prewitt | ..... | 473/236 |
| 6,827,655 | B2 * | 12/2004 | Burns | ..... | 473/236 |
| 6,872,149 | B1 * | 3/2005 | Devon | ..... | 473/231 |
| 7,104,898 | B1 * | 9/2006 | Caserta | ..... | 473/236 |
| 7,104,899 | B1 * | 9/2006 | Caserta | ..... | 473/236 |
| 2006/0276258 | A1 * | 12/2006 | McLaughlin | ..... | 473/236 |

* cited by examiner

*Primary Examiner*—Sebastiano Passaniti
(74) *Attorney, Agent, or Firm*—Raymond M. Galasso; Galasso & Associates, LP

(57) ABSTRACT

A putting training device having two alignment guides positioned to extend from the blade of a putter. In one embodiment the alignment guides extend generally parallel to each other to facilitate a generally parallel putting stroke. In an alternative embodiment, each of the alignment guides generally arcuate in shape and extends from the blade of the putter in a generally concentric manner, to facilitate a generally arcuate putting stroke. The ends of the alignment guides are tapered to prevent the alignment guides from catching on the putting surface. Additionally, at least one of the alignment guides is movable, such that the space between the two alignment guides can tailored for the experience level of each user.

6 Claims, 3 Drawing Sheets

PUTTING TRAINING DEVICE

FIELD OF THE INVENTION

The present invention relates to golf training devices, and more particularly, but not by way of limitation to an adjustable device that is removably attached to a putter blade for training a golfer's putting stroke.

BACKGROUND OF THE INVENTION

Recreational sports and hobbies are popular all around the world. It is when a person is in the pursuit of some degree of proficiency in these types of activities that a diversion from the routine patterns of life can be experienced. Many times, a person may excel in a particular side interest or pastime to such a degree that they may be competitive with others who have the same interests. A person may enjoy bowling, for example, and find that competing in a league against other bowlers provides them with a great measure of enjoyment.

Those who participate in sports as a recreational activity and who desire to have some measure of success in so doing must develop and maintain a certain level of proficiency in the sport's skills. For baseball players, the ability to swing the bat in harmonious manner with the movement of the player's body is critical to successful contact with the baseball. Tennis players must also have the swinging motion coordinated with body movement and eye contact in order to play the game with success. Others who play sports such as racquetball and table-tennis have similar physical attributes that must be developed.

Golfers are among those who practice a great deal in order to prepare themselves to play with any degree of competence. They must be able to hit the golf ball with any of a number of different clubs properly under a variety of circumstances. Many golfers hire trainers to assist them in developing their golfing skills. Hours of time may be spent in preparation for a single game. The use of a driving range at a golf course, golf school, or public practice area is often a part of a golfer's training and preparation for a round of golf.

Of the many aspects of playing golf, putting is one of the most important components in the game. As a golfer must keep their head very still, in a fixed position during the putting stoke, it is very difficult for the golfer to determine whether the blade of the putter is being drawn back properly during the backswing and whether the blade of the putter is maintained in the proper orientation during the putt. If the golfer's head moves to watch the putter during the putt stroke, the rest of the putting stroke can be affected. Therefore, it is not only important that a golfer be able to practice a mechanically sound putting stroke, but also to be able to readily determine that the putting stroke is being done properly As can be appreciated, there is a need for improved golf training devices that can be used while practice putting to not only help develop a good putting stroke, but can also provide feedback to the golfer that the putting stroke is proper.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
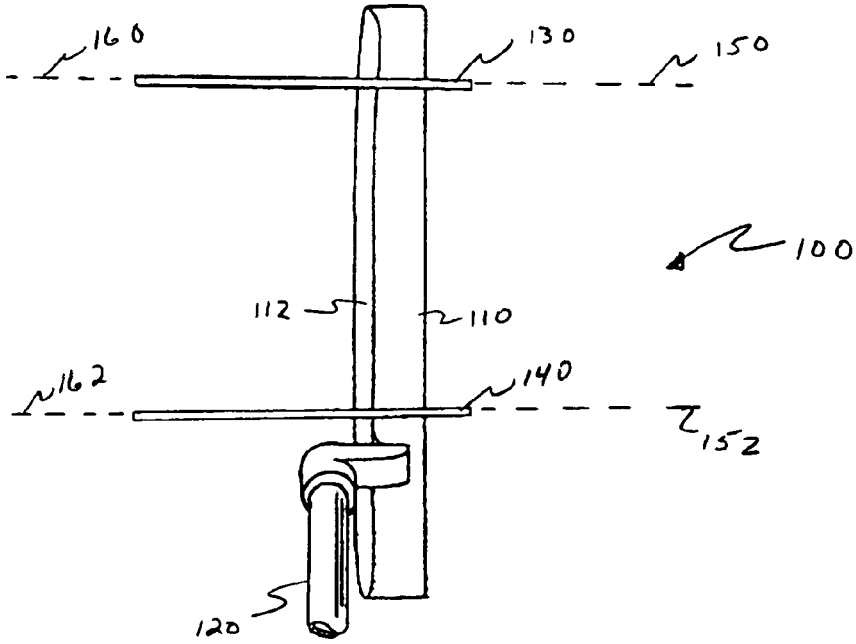
FIG. 1 illustrates a top view of a preferred embodiment of the present invention.

Referring now to the drawings wherein the various elements depicted are not necessarily drawn to scale, and in particular, to FIG. 1 there is shown a putting training device 100. As illustrated putting training device 100 includes a putter head 110 connected to a putter shaft 120. Two alignment guides, 130 and 140 are connected to putter head 110. Alignment guides 130 and 140 are connected to putter head 110 being generally parallel to each other, and generally perpendicular to the face 112 of putter head 110. In a preferred embodiment, alignment guide 140 is attached in a fixed position on putter head 110, while alignment guide 130 is movable with respect to alignment guide 140 such that the space between alignment guides 130 and 140 can be adjusted. Dashed lines 150, 152, 160 and 162 represent a desired proper parallel putting stroke, with dashed lines 150 and 152 illustrating the desired proper backswing of putting training device 100, and dashed lines 160 and 162 illustrating the desired proper follow through.

Figure 2:
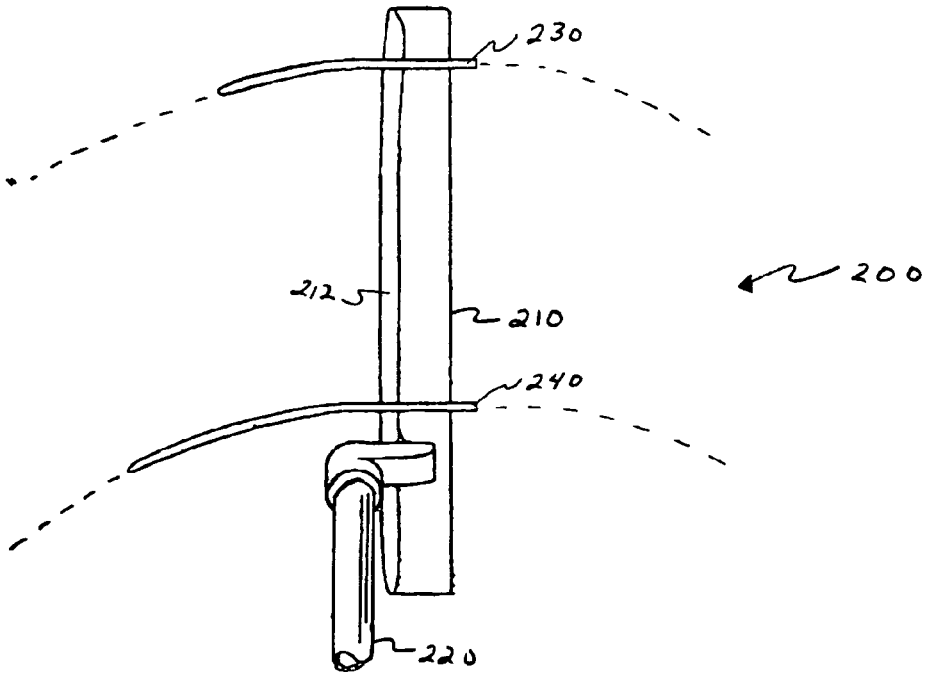
FIG. 2 illustrates a top view of an alternative embodiment of the present invention.

Referring now to FIG. 2, there is illustrated an alternative embodiment of a putting training device 200. As illustrated putting training device 200 includes a putter head 210 connected to a putter shaft 220. Two, generally arcuate alignment guides 230 and 240 are connected to putter head 220. In a preferred embodiment, alignment guide 240 is attached in a fixed position on putter head 210, while alignment guide 230 is movable with respect to alignment guide 240 such that the space between alignment guides 230 and 240 can be adjusted. Additionally, in this preferred embodiment, alignment guide 230 is shorter than alignment guide 240 to allow the proper arcuate stroke of putting training device 200. Dashed lines 250, 253, 260 and 263 represent a desired proper arc shaped putting stroke, with dashed lines 250 and 252 illustrating the desired proper backswing of putting training device 200, and dashed lines 260 and 262 illustrating the desire proper follow through.

Figure 3:
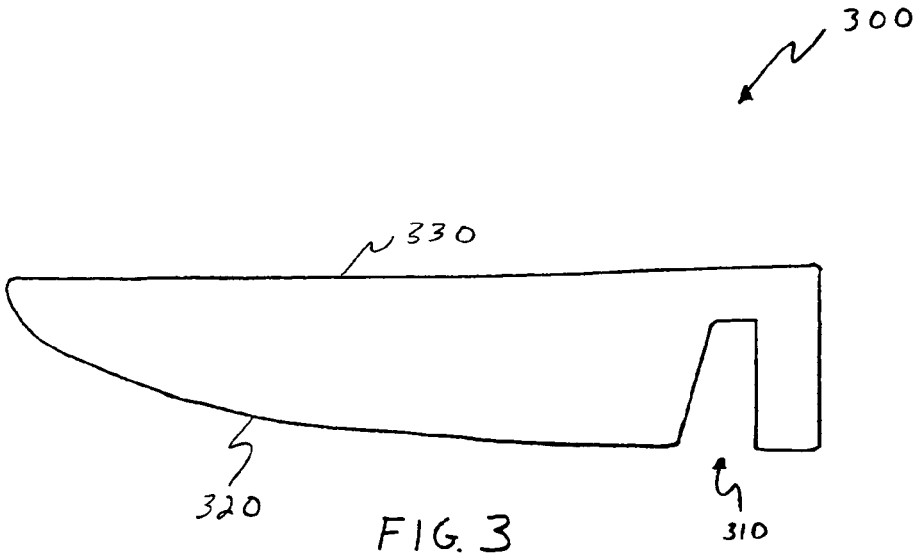
FIG. 3 illustrates a side view of an alignment guide in accordance with the principles of the present invention.

Referring not to FIG. 3, there is illustrated a side view of an example of a preferred embodiment of an alignment guide 300, such as illustrated in FIGS. 1 and 2. As illustrated, alignment guide 300 has a notch 310 which is cut to correspond or mate with the shape the putter head or mounting mechanism on which it is to be used. Edge 320 is tapered from the front of top edge 330 towards notch 310, to facilitate the smooth movement of alignment guide 300 during a putting swing by at least preventing edge 320 from catching on the putting surface. It is contemplated that alignment guide 300 be attached to a putter head using suitable mechanical or chemical attachment methods. Good results have been achieved by manufacturing alignment guide 300 from metals, such as thing various types of sheet metal, or from various types of plastics. It is desirable that the chosen material for alignment guide 300 be non-corrosive, durable and strong. It is further desired that the material having a high impact strength and be able to accept and retaining coloring materials for an extended length of time.

It is contemplated that alignment guide 300 could be bendable such that, for example, if a golfer utilized an arcuate putting stroke, alignment guide 300 could be readily bend to a particular arc shape to coincide with the golfer's putting stroke.

Figure 4:
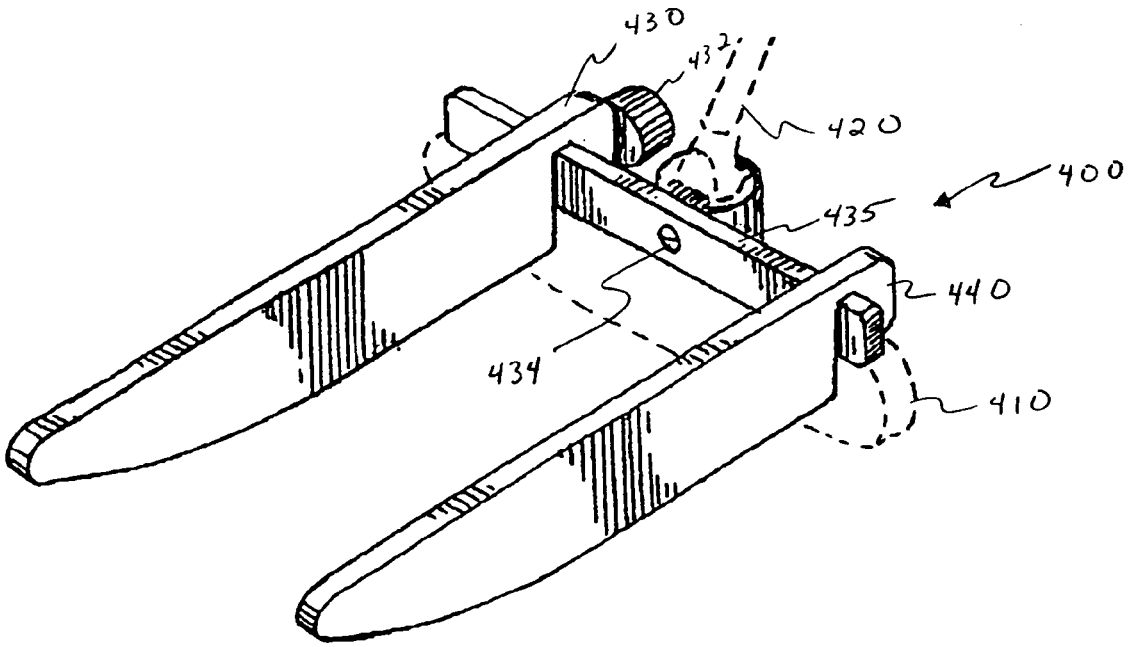
FIG. 4 illustrates a top perspective view of an alternative embodiment of the present invention showing an attachment mechanism for alignment guides.

Referring now to FIG. 4, there is illustrated an alternative embodiment of a putting training device 400. As illustrated, putting training device includes generally parallel alignment guides 430 and 440 and a mounting bracket 435, with alignment guides 430 and 440 being similar in shape to alignment guides 130 and 140 of FIG. 1. Alignment guide 440 is fixed to mounting bracket 435 while alignment guide 430 is removably secured to mounting bracket 435 with a screw, such as a thumb screw 432. Thumb screw 432 can be loosened to allow the adjustment of the position of alignment guide 430, such that the space between alignment guides 430 and 400 can be changed. Mounting bracket 435 is placed on the top of putter blade 410 and secured to the putter shaft 420 with a screw 434.

Figure 5:
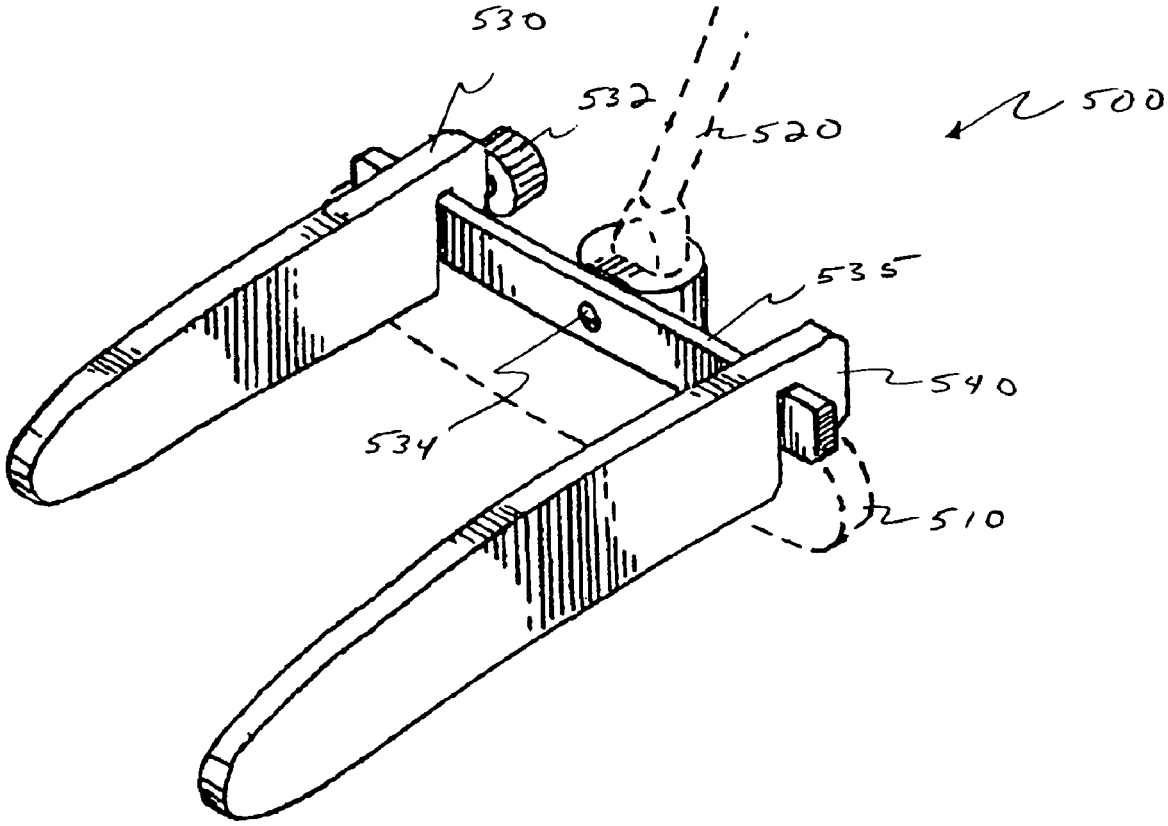
FIG. 5 illustrates a top perspective view of another alternative embodiment of the present invention illustrating showing an attachment mechanism for the generally arcuate alignment guides.

Referring now to FIG. 5, there is illustrated an alternative embodiment of a putting training device 500. As illustrated, putting training device includes generally arcuate alignment guides 530 and 540 and a mounting bracket 535, with alignment guides 530 and 540 being similar in shape to alignment guides 230 and 240 of FIG. 2. Alignment guide 540 is fixed to mounting bracket 535 while alignment guide 530 is removably secured to mounting bracket 535 with a screw, such as a thumb screw 532. Thumb screw 532 can be loosened to allow the adjustment of the position of alignment guide 530, such that the space between alignment guides 530 and 500 can be changed. Mounting bracket 535 is placed on the top of putter blade 510 and secured to the putter shaft 520 with a screw 534.

As there are at least two schools of thought on putting strokes, a parallel or straight back stroke, and an arcuate stroke, it is anticipated that putting training device 100 be utilized by a golfer practicing the parallel putting stroke and that putting training device 200 be utilized by a golfer practicing an arcuate stroke.

Referring now to FIG. 1, the operation of putting training device 100 will now be described. A user or golfer adjusts the position of alignment guide 130 such that the desired space between alignment guides 130 and 140 for the golfer is achieved. For example, the alignment guides 130 and 140 would be set far apart for beginners and set increasingly closer as the golfer's putting skills become more precise. Alignment guides 130 and 140 are then aligned or pointed at the hole or target. A golf ball is placed between alignment guides 130 and 140. As the golfer starts the backswing of putting training device 100, there is instant visual and mechanical feedback on whether the putter face 112 is staying square or is rotating. If putter face 112 is rotating, alignment guides 130 and 140 will provide visual feedback to the golfer by rotating and emphasizing that they are no longer pointing to the target. Additionally, if the putter face 112 rotates sufficiently such that the golf ball comes into contact with one of alignment guides 130 and 140, a vibration will be felt by the golfer. If putter face 112 is maintained in a substantially square alignment during the backswing, alignment guides 130 and 140 will provide visual feedback to the golfer, as alignment guides 130 and 140 will continue to substantially point to the target. Additionally, no contact will be made between the golf ball and the alignment guides 130 and 140 and no vibration will be felt by the golfer.

Similarly, as the golfer makes a forward swing with putting training device 100, if the proper alignment of putter face 112 is not maintained, alignment guides 130 and 140 will provide visual feedback to the golfer by rotating and emphasizing that they are no longer pointing to the target. Additionally if the rotation of the putter face 112 is great enough, the golf ball will come into contact with one of the alignment guides 130 and 140 and a vibration will be felt by the golfer. If the proper alignment of putter face 112 is maintained, alignment guides 130 and 140 will provide visual feedback to the golfer, as alignment guides 130 and 140 will continue to substantially point to the target. Additionally, no contact will be made between the golf ball and alignment guides 130 and 140, and no vibration will be felt by the golfer. As can be appreciated, the closer alignment guides 130 and 140 are placed together, the amount of deviation of the alignment of putter face 112 that is needed to have the alignment guides 130 and 140 come into contact with the golf ball is decreased.

Referring now to FIG. 2, the operation of putting training device 200 will now be described. A user or golfer adjusts the position of alignment guide 230 such that the desired space between alignment guides 230 and 240 for the golfer is achieved. For example, the alignment guides 230 and 240 would be set far apart for beginners and set increasingly closer as the golfer's putting skills become more precise. The putter face 212 is aligned or pointed at the hole or target. A golf ball is placed between alignment guides 230 and 240. As the golfer starts the backswing of putting training device 200, there is instant visual and mechanical feedback on whether the putter face 212 is staying properly aligned. If putter face 212 is rotating, alignment guides 230 and 240 will provide visual feedback to the golfer by rotating with the putter face 212 and emphasize that the putter face 212 is no longer aligned to the target. Additionally, if the putter face 212 rotates sufficiently such that the golf ball comes into contact with one of alignment guides 230 and 240 a vibration will be felt by the golfer. If putter face 212 is maintained in proper alignment during the arcuate backswing, alignment guides 230 and 240 will provide visual feedback to the golfer. Additionally, if putter face 212 is maintained in proper alignment, no contact will be made between the golf ball and the alignment guides 230 and 240, whereby no vibrations will be felt by the golfer.

Similarly, as the golfer makes a forward swing with putting training device 200, if the proper alignment of putter face 212 is not maintained, alignment guides 230 and 240 will provide visual feedback to the golfer by being rotated, thus emphasizing that the putter face 212 is no longer properly aligned. Additionally, if the rotation of the putter face 212 is great enough, the golf ball will come into contact with one of the alignment guides 230 and 240 such that vibrations will be felt by the golfer.

If the proper alignment of putter face 212 is maintained, alignment guides 230 and 240 will provide visual feedback to the golfer, as the putter face 212 will continue to substantially point to the target. Additionally, no contact will be made between the golf ball and alignment guides 230 and 240, and no vibration will be felt by the golfer. As can be appreciated, the closer alignment guides 230 and 240 are placed together, the amount of deviation of the alignment of putter face 212 that is needed to have the alignment guides 230 and 240 come into contact with the golf ball is decreased.

Although alignment guides 140 and 240 are described as fixed and alignment guides 130 and 230 are described as being movable in preferred embodiments of training devices 100 and 200, it is contemplated to be within the scope of this that either or both of the alignment guides of each putting training device 100 and 200 be adjustable with respect to the other alignment guide, or that neither alignment guide be adjustable, i.e. both are attached at a preset fixed position.

As can be appreciated, putting training devices 100 and 200 will help a golfer develop a steady smooth swing while minimizing the margin of error. This is accomplished by training the golfer to have the face of the putter strike the ball square and to facilitate a complete follow through.

It is further contemplated that the alignment guides of putting training devices 100 and 200 be connected together such that they could be attachable to the shaft of the putter where the shaft joins the club head (see FIGS. 4 and 5), such that the putting training devices could be utilized with virtually any shaped putter.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A putting training device for a golf putter, comprising:

a putter head;

a first alignment guide having a first notch proximate one end of the guide that is positionable adjacent said putter head and a tapered edge extending from said first notch to an opposite end that is spaced longitudinally from said first end; said first notch operable to mate with the shape of said putter head; and wherein said first alignment guide is fixedly attached to said putter head; and a second alignment guide having a second notch proximate one end of the guide that is positionable adjacent said putter head and a tapered edge extending from said second notch to an opposite end that is spaced longitudinally from said second end; said second notch operable to mate with the shape of said putter head; and wherein said second alignment guide is slidably attached to said putter head; said second alignment guide being spaced apart from the first alignment guide at a selected distance.

2. The putting training device as recited in claim 1, wherein said first alignment guide and said second alignment guide are generally parallel.

3. A putting training device, comprising:

a putter blade, said putter blade being generally elongated having a first end and a second end;

a shaft attached to the putter blade and extending upward from said putter blade;

a mounting bracket having a first end and a second; said mounting bracket attached to the putter shaft with a screw; said mounting bracket being proximate the top of the putter blade;

a first alignment guide having a first notch proximate one end of the guide that is positionable adjacent said putter head and a tapered edge extending from said first notch to an opposite end; said first notch operable to mate with the mounting bracket; and wherein said first alignment guide is fixedly attached to said mounting bracket;

a second alignment guide having a second notch proximate one end of the guide that is positionable adjacent said putter head and a tapered edge extending from said second notch to an opposite end; said second notch operable to mate with said mounting bracket; and wherein said second alignment guide is slidably attached to said mounting bracket; said second alignment guide being spaced apart from said first alignment guide at a selected distance and secured to said mounting bracket with a thumb screw, and therein said second alignment guide is longer than said first alignment guide.

4. A putting training device, comprising:

a putter blade, said putter blade being generally elongated having a first end and a second end;

a first alignment guide comprising a front edge, a top edge and a bottom edge and a first notch cut in said bottom edge to correspond with the butter blade for attaching the first alignment guide to the putter blade and wherein said first alignment guide is slidably attached towards said first end of said putter blade;

a second alignment guide comprising a front edge, a top edge, a bottom edge and a second notch cut to correspond with the putter blade for attaching the second alignment guide to the putter blade and wherein said second alignment guide is fixedly attached towards said second end of said putter blade, said second alignment guide being spaced apart from said first alignment guide at a selected distance; and said first alignment guide is movably attached to said putter blade, such that the selected distance between said first alignment guide and said second alignment can be varied.

5. The putting training device as recited in claim 4, wherein said first alignment guide and said second alignment guide are attached to said putter blade such that said first alignment guide is generally parallel with said second alignment guide.

6. The putting and training device as recited in claim 4, wherein said first alignment guide is generally arcuate in shape along said bottom edge from said front edge towards said first notch and said second alignment guide is generally arcuate in shape along said bottom edge from said front edge towards said second notch.

* * * * *